US010692404B2

(12) United States Patent
Ho

(10) Patent No.: US 10,692,404 B2
(45) Date of Patent: Jun. 23, 2020

(54) TRAPEZOIDAL DISPLAY BOX WITH CUTTING AND CREASING DESIGN AND MOUNTING SYSTEM FOR FORMATION OF COMMUNICATION ARCH WITH AUTOMATIC ADJUSTMENT AND STRUCTURING

(71) Applicant: Wang Yung Ho, São Paulo (BR)

(72) Inventor: Wang Yung Ho, São Paulo (BR)

( * ) Notice: Subject to any disclaimer, the term of this patent is extended or adjusted under 35 U.S.C. 154(b) by 48 days.

(21) Appl. No.: 16/045,926

(22) Filed: Jul. 26, 2018

(65) Prior Publication Data

US 2019/0051221 A1 Feb. 14, 2019

(30) Foreign Application Priority Data

Aug. 10, 2017 (BR) ..... 202017017195

(51) Int. Cl.
*G09F 7/18* (2006.01)
*B31B 50/26* (2017.01)
(Continued)

(52) U.S. Cl.
CPC ..... *G09F 7/18* (2013.01); *B31B 50/26* (2017.08); *B31D 5/04* (2013.01); *B65D 5/00* (2013.01);
(Continued)

(58) Field of Classification Search
CPC ..... G09F 7/18; B31B 50/26; B65D 5/001; B65D 2313/00; B65D 21/0209; B65D 2571/00895; B65D 5/008
USPC ..... 229/112, 120, 113, 178, 916, 108, 229/117.16, 122.29, 155, 156, 185, 229/120.01, 120.011; 206/508, 509; 493/137, 84
See application file for complete search history.

(56) References Cited

U.S. PATENT DOCUMENTS 3,895,754 A * 7/1975 Rosenburg, Jr. ..... B65D 5/32 206/521
4,245,771 A * 1/1981 Christian ..... B65D 5/6685 229/112
(Continued)

FOREIGN PATENT DOCUMENTS

BR 202016014781-1 6/2016

*Primary Examiner* — Christopher R Demeree
(74) *Attorney, Agent, or Firm* — B. Aaron Schulman, Esq.; Stites & Harbison, PLLC

(57) ABSTRACT

Formation of a communication arch (A) over a consumer corridor, such as in large sales points, displaying at a height, a media (M) related to a certain product. For such, after mounting a display box (35) using the cutting and creasing design, its units are mounted to one another by coupling through the coupling flaps (29) of one unit to the cutouts (4) corresponding to the subsequent unit. After mounting the assembly, when it is raised and has its peripheral units settled over two opposite shelves, such as in a supermarket corridor, through the trapezoidal geometry of the display boxes (35) combined to slide coupling flaps (29) and cutouts ( ) between the units (35), there is a radial movement and positioning for its tops (16) while its bottoms (6) meet, providing the structuring of the assembly, in an arch shape, supporting the resulting stresses imposed vertically from top to bottom of the arch formed. Therefore, the communication arch (A) formed can receive a large media at its highest point.

5 Claims, 12 Drawing Sheets

(51) Int. Cl.

| | |
|---|---|
| ***B31D 5/04*** | (2017.01) |
| ***B65D 5/00*** | (2006.01) |
| ***B65D 5/02*** | (2006.01) |
| ***B65D 5/42*** | (2006.01) |

(52) U.S. Cl.
CPC ..... *B65D 5/0254* (2013.01); *B65D 5/427* (2013.01); *G09F 2007/1856* (2013.01)

(56) References Cited

U.S. PATENT DOCUMENTS

| | | | | |
|---|---|---|---|---|
| 4,778,392 | A * | 10/1988 | Mitchell | G09B 1/00 206/509 |
| 5,462,220 | A * | 10/1995 | Bacchetti | B65D 5/001 229/112 |
| 2015/0076143 | A1* | 3/2015 | Ryan | B65D 1/225 220/4.28 |

* cited by examiner

DET. A 9
15
25
23
12
13
8
22
6
15
1
16
27

DET. B 11
9
10
8a
25
26
21
24
23
22a
22
8

35

35

CORTE A-A

TRAPEZOIDAL DISPLAY BOX WITH CUTTING AND CREASING DESIGN AND MOUNTING SYSTEM FOR FORMATION OF COMMUNICATION ARCH WITH AUTOMATIC ADJUSTMENT AND STRUCTURING

FIELD OF THE INVENTION

The present invention refers to a patent application for a display that, after mounted, it gains the pattern of a trapezoidal box, then proposing the coupling of various units to form a communication arch placed in the corridor or supermarkets, shopping centers and big magazines, attached between one shelf and another. In its highest semi-circular part, this communication arch receives a large media that will be seen by the consumers that pass through the corridors.

BACKGROUND OF THE INVENTION

As it is known, there is currently an increasing use of cardboard displays developed by cutting and creasing designs to obtain shapes that are more sophisticated to meet the requirements of supermarkets, shopping centers and big magazines, in order to display and carry their products.

These are generally mounted from a plane condition such as the case of the display protected by document BR 202016014781-1 entitled "PROVISION INTRODUCED IN PACKAGING TRANSFORMABLE INTO DISPLAY", where, through side creases, its flaps are folded to form the walls, the top with a locking tab in a front cutout. The front part is delimited by an oblique punch that is to be removed after mounting the box. When removed, the front part of the box forms an angular opening from the side walls to the rear wall, in order for the user to keep the products, viewed in the form of a display. Images were extracted from this document BR 202016014781-1 to show the sequence of a form of display mounting. This sequence was included as FIG. 1 of the application to be explained afterwards.

In any way, the displays are not usually designed to display products at great height, being generally supported on the floor together with the shelves, attached to columns or on floors, totems and other types of points to carry the messages.

The points at great heights in large sales establishments are explored with displays hanging alone from the ceiling, placed above the corridors, having a certain eye-catching appeal.

SUMMARY OF THE INVENTION

The present invention proposes that, after following the specific cutting and creasing design, a cardboard paper will have the shape of a display box with slight reduction of width from the top to the bottom, with trapezoidal geometry, having adjustable flaps on the sides and corresponding cutouts on the opposite side.

At the installation site, the units of these display boxes will be mounted to one another with the insertion of the flaps of one unit in the cutouts of the subsequent unit.

After mounting, when the assembly is raised to be attached one point distant from another (for example, between supermarket shelves), the top of these display boxes are moved away from one another by sliding the flaps through the cutouts through a distance delimited by a locking system, simultaneous to the bottoms meeting.

Through the slightly distanced tops, the assembly obtains an arched shape, self-supported, but through the adjacent edges of their bottoms strongly brought together, supporting the pressure from the top to the bottom without requiring any additional support, able to receive a large media and positioned at a high height between the shelves, carrying a strong advertising/informative appeal.

In FIG. 1 below is the sequence obtained from the document BR 202016014781-1 to exemplify the state of the art Figures from 2 to 22, refer to the display box, its cutting and creasing design, mounting and adjustment to obtain the communication arch:

A large media was attached to the upper part of the communication arch, causing, together with the arch, a huge visual impact.

DETAILED DESCRIPTION OF THE INVENTION

Figure 1:
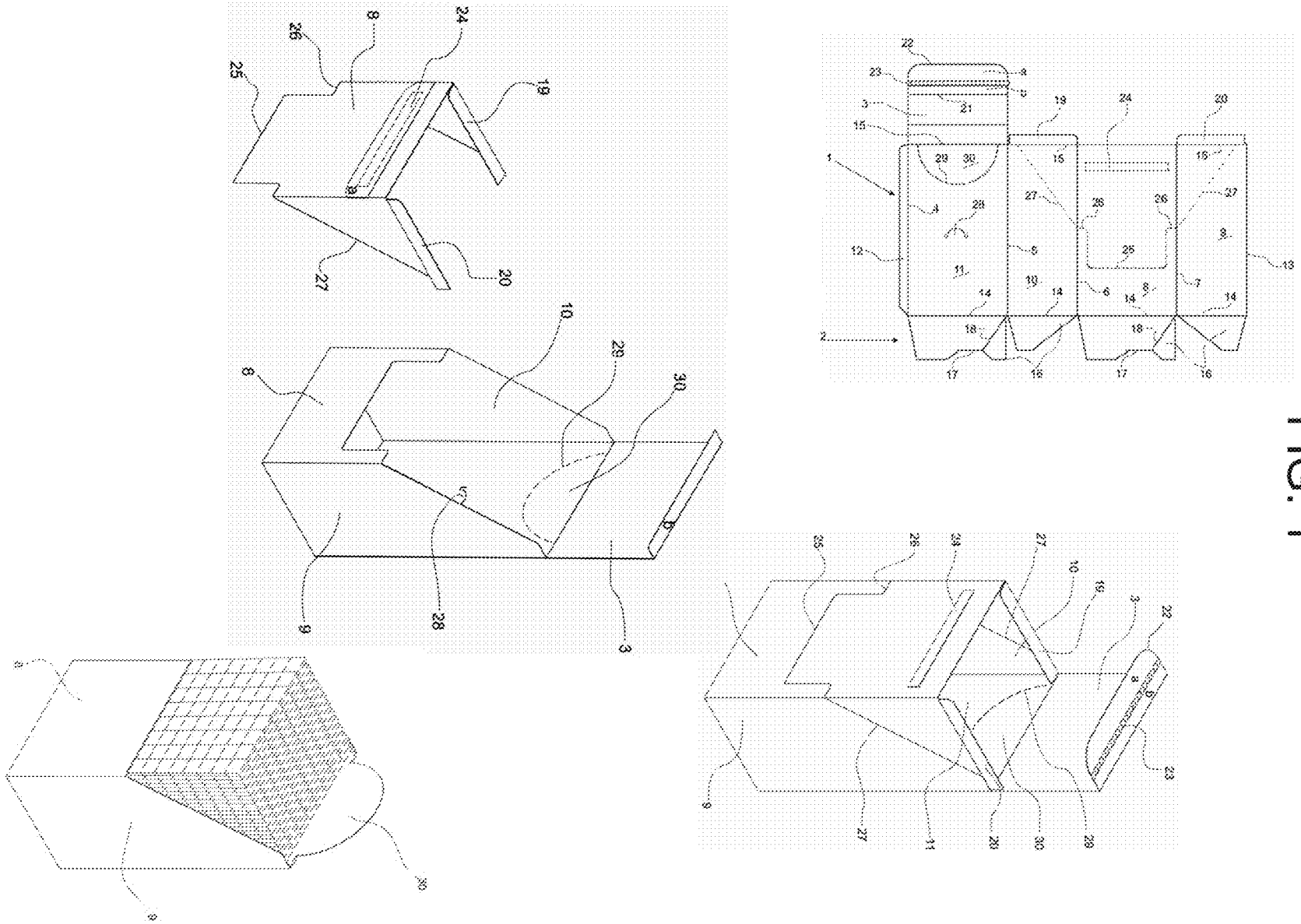
FIG. 1 shows a box of the Prior Art
Figure 2:
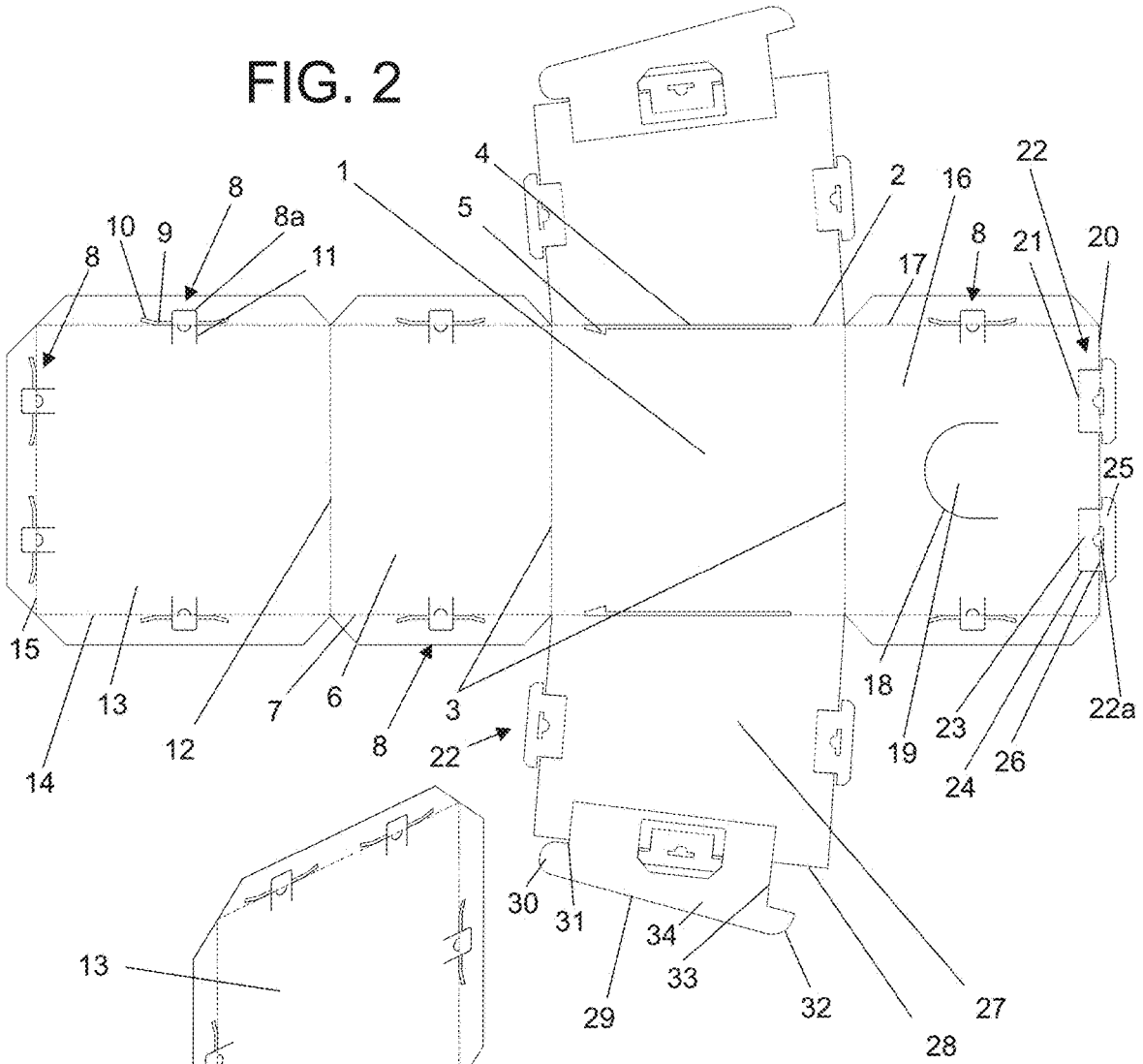
FIG. 2 is a plan view of the unassembled display box.

As shown in FIG. 1, the trapezoidal display box is based on a cutting and creasing design for cardboard, comprising a mounting base (1) delimited by side creases (2) and (3) of which there are respective cutouts (2) with arrow ends (5) at creases (2). From one of the creases (3), it extends to the bottom (6), delimited by side creases (7) hollowed by a set of male coupling (8) consisting of the cutout (9) of angled extremities (10) and including a flap (11) with male locking tab (8*a*). Said bottom (6) has a crease (12) positioned opposite crease (3), from where the side face (13) extends, delimited by its side creases (14) equally equipped with male couplings (8), and the crease (15) opposite the crease (12) also receives a pair of male couplings (8), but in alignment and in a cross-sectional position.

From the crease (3) opposite the base (1), it extends to the top (16), delimited by its side creases (17) also equipped with male couplings (8), and this top (16) is hollowed by the center cutout (18) delimiting the semi-circle flap (19), in addition to receiving a crease (21) on the free edge (20) for the female coupling (22) consisting of a reentrant flap (23) for cutouts (24) and incorporating a locking tab (25) with crease (26), interrupted by rectangular center cutout opposite a semicircular cutout forming the female cutout (22*a*).

From the creases (2) of the base (1), the front faces (27) extend with the free edges equipped with their female couplings (22). These front faces (27) protrude, from their peripheral edge (28), an angled coupling flap (29), defined by a coupling end (30) with supporting part (31) of smaller height. On the opposite side, this angled coupling flap (29) forms a stop (32) with displacement part (33) of greater height. The coupling flap (29) also receives a reinforcement glue (34) on its inner side.

Figure 3:
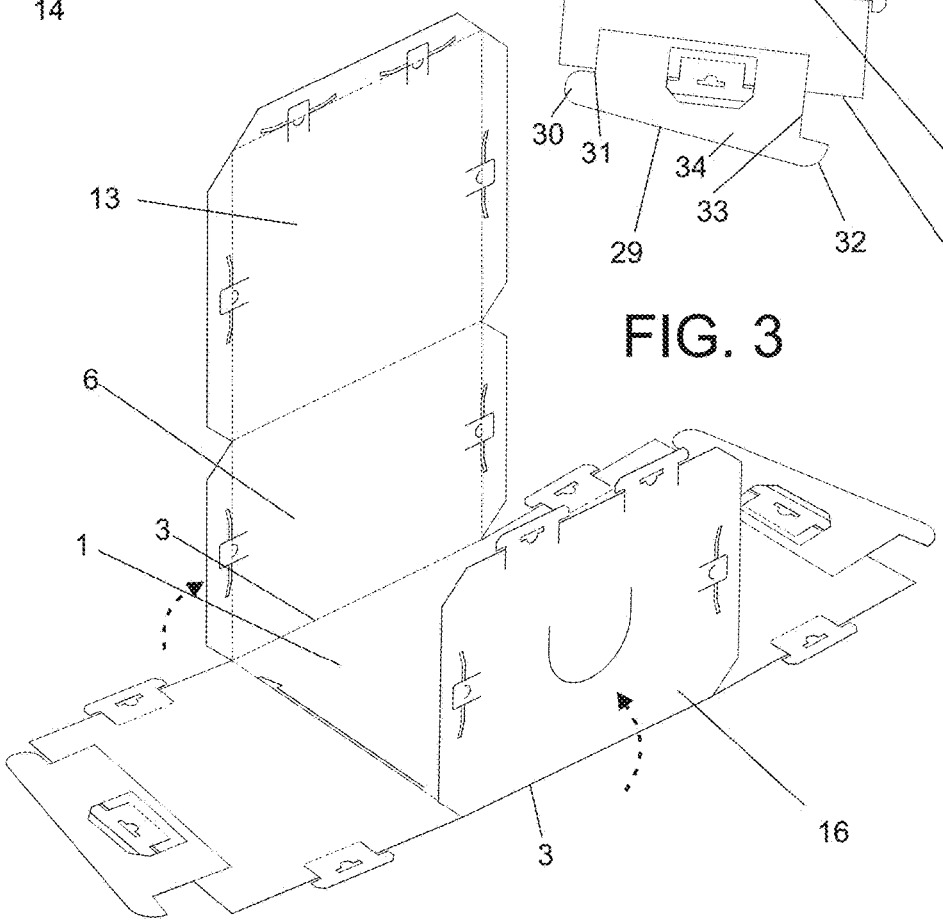
FIG. 3 shows, from the base of the assembly, the bottom connected to one of the side faces and the top, joined and positioned in parallel.
Figure 4:
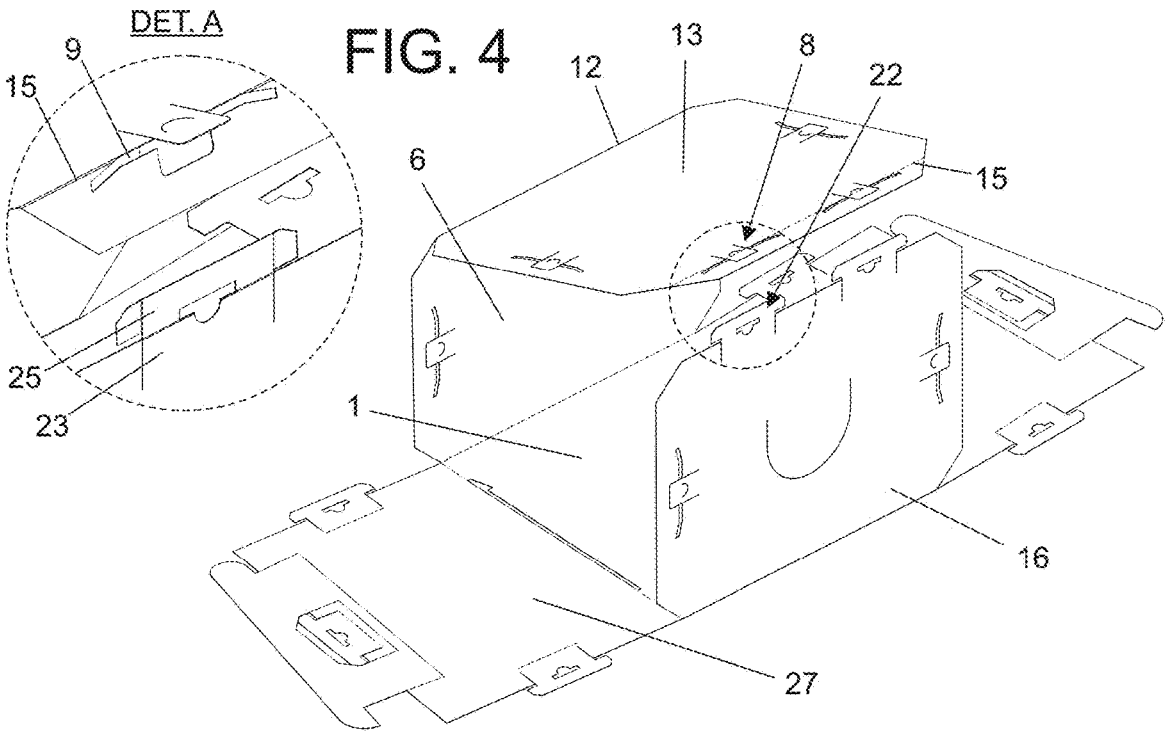
FIG. 4 shows the side face folded towards the top. Detail A shows the male coupling of the side face mounted, aligned to the female coupling of the top, for locking.
Figure 5:
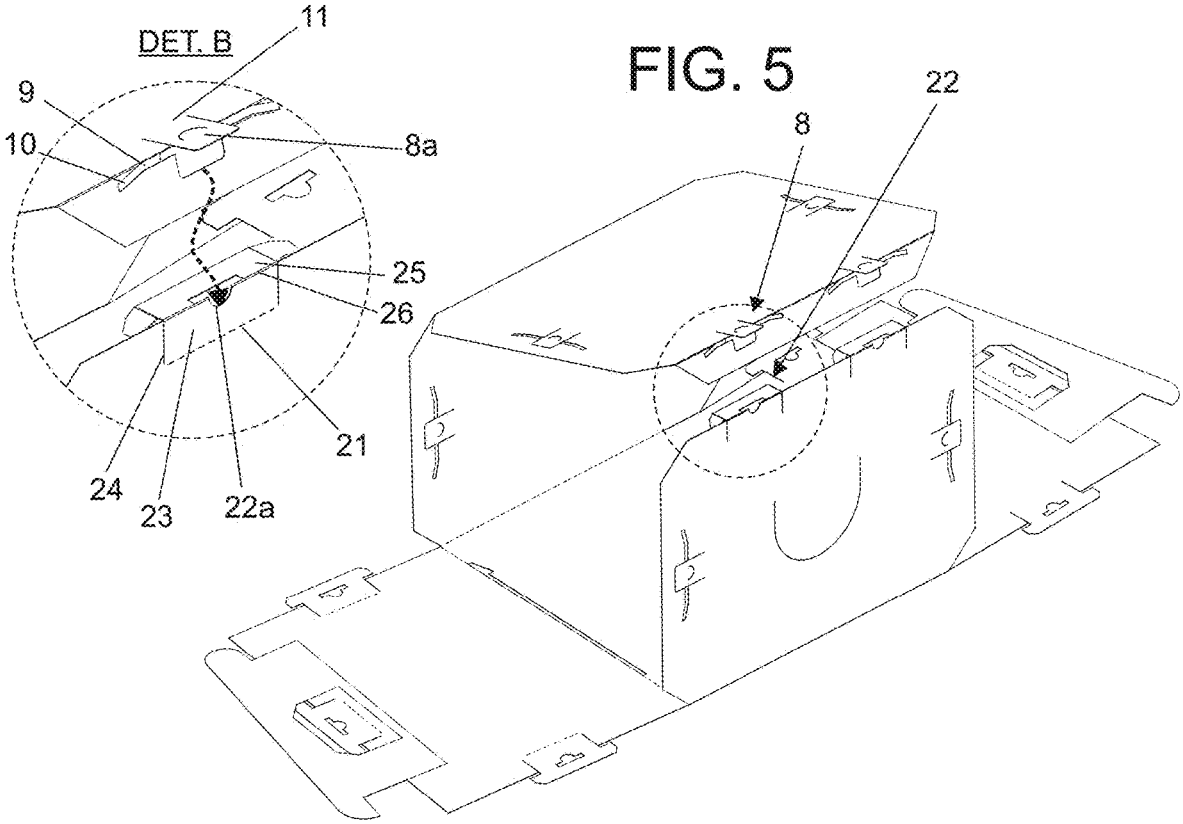
FIG. 5 shows, according to the previous figure, the female coupling mounted to receive the male coupling. This alignment is shown in detail B.
Figure 6:
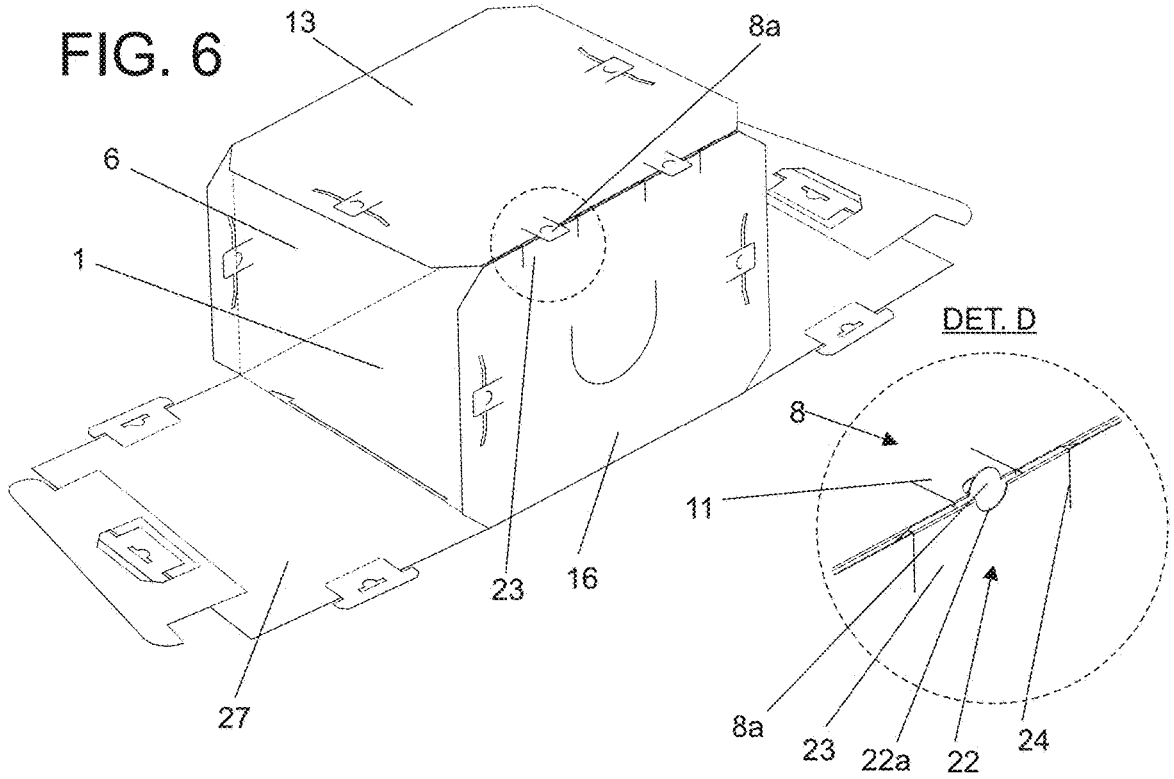
FIG. 6 shows the side face already locked at the top. Detail D shows the external lock.
Figure 7:
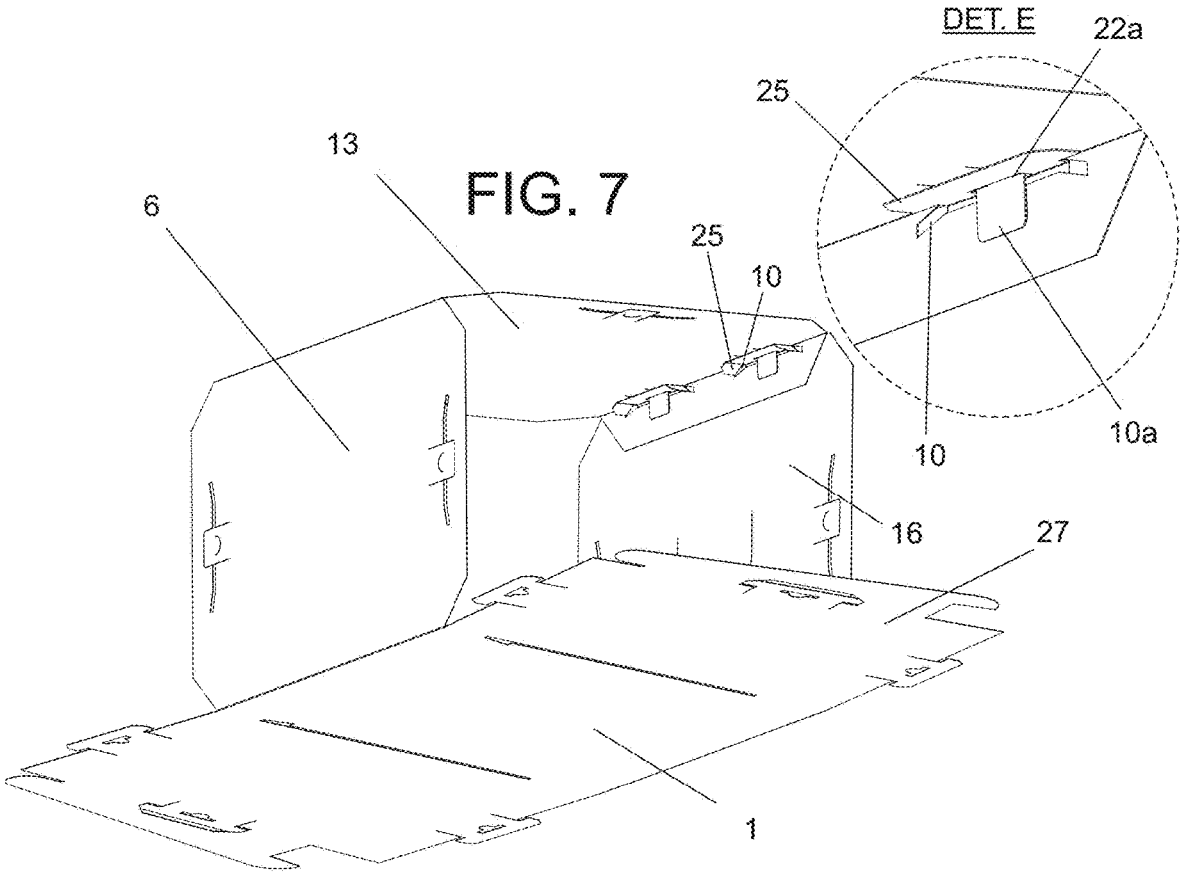
FIG. 7 is a lower perspective view of FIG. 6. Detail E shows the internal lock.

To mount, from the creases (3), the bottom (6) and the top (16) are positioned on the vertical, as shown in FIG. 3, folding through the crease (12) the side face (13) and then folding its crease (15) to align the cutouts (9) to the flap (23) with the extremities of its locking tab (25) folded to insert into the angled terminal (10), as shown in detail A of FIG. 4. Next, the male locking tab (8*a*) of the male coupling (8) is folded and inserted in the female cutout (22*a*) of the female coupling (22) of the top (16), as shown in detail B of FIG. 5. This is how the bottom (6), side face (13) and top (16) are locked, as also shown in FIG. 6 and its detail D and FIG. 7 and its detail E.

Figure 8:
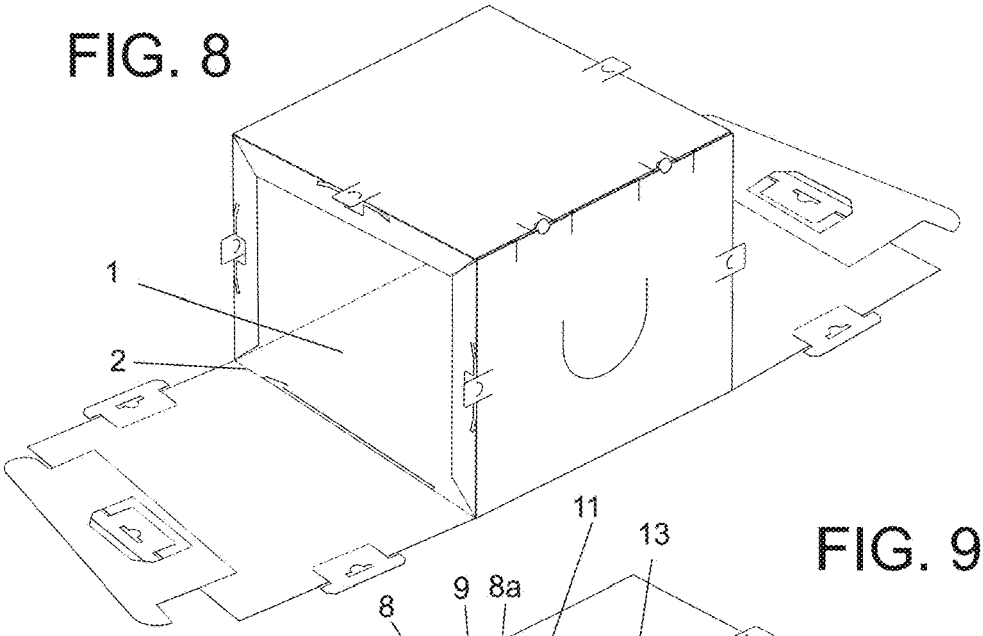
FIG. 8 shows the male couplings of the side face and the top, mounted, aligned to the female couplings of the front faces.
Figure 9:
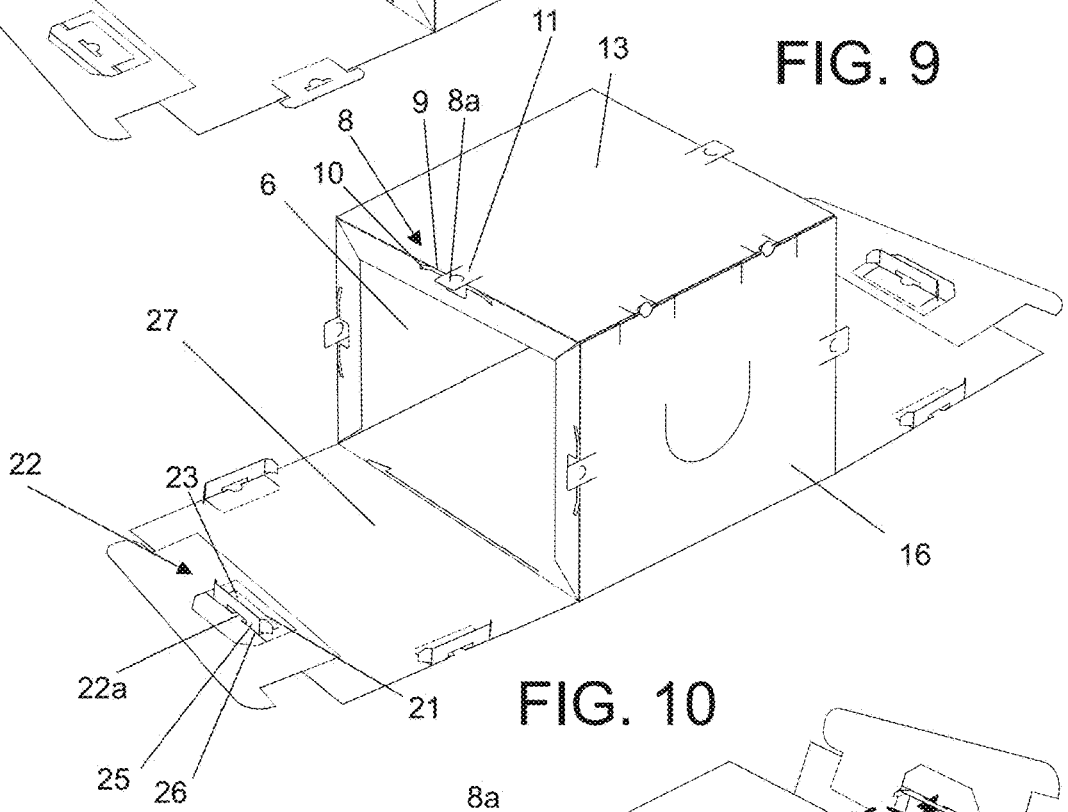
FIG. 9 shows the female couplings of the front faces aligned to the male couplings of the side face and top.
Figure 10:
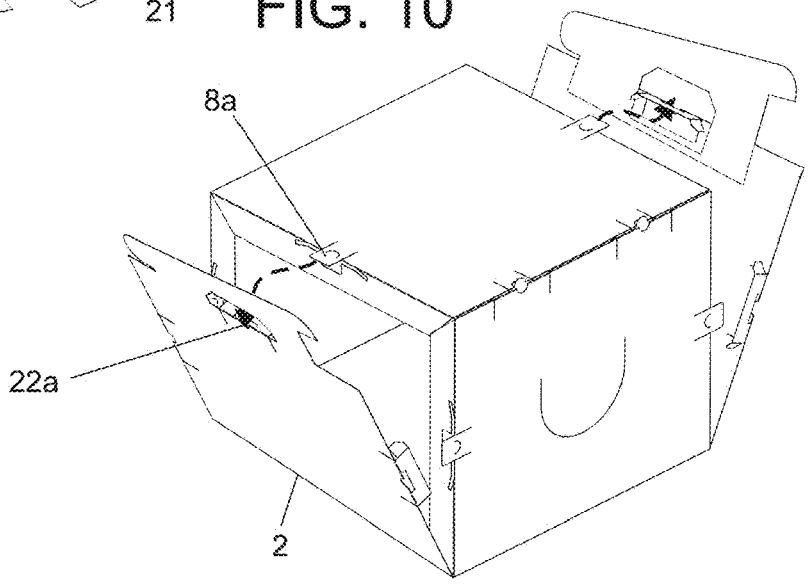
FIG. 10 shows the front faces being brought up against the side face and the top, to interlock the male and female couplings.
Figure 11:
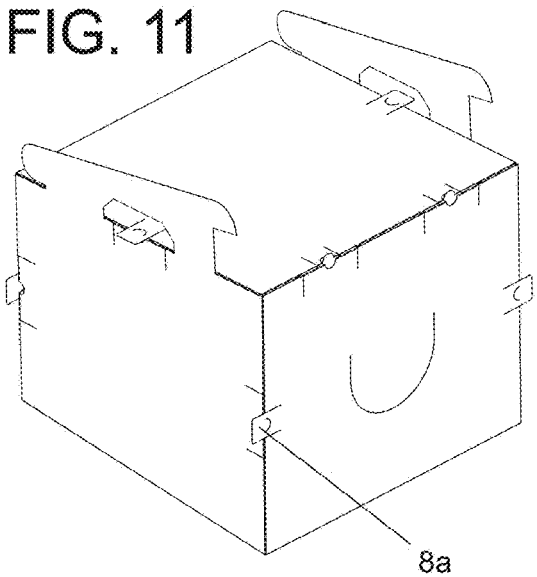
FIG. 11 shows the front faces already locked to the side face, to the top and to the bottom, with the display box mounted.
Figure 12:
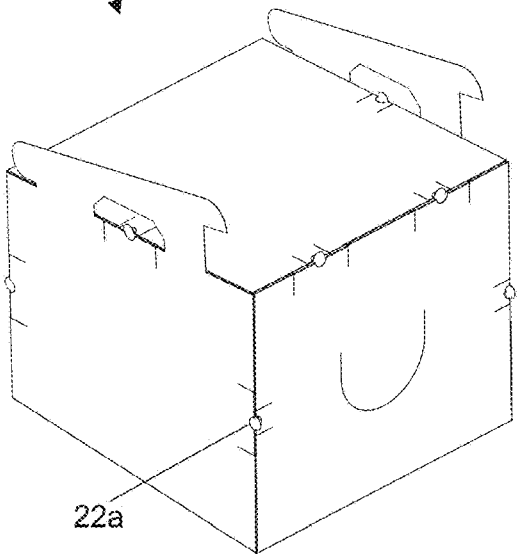
FIG. 12 shows the end of the external lock.
Figure 13:
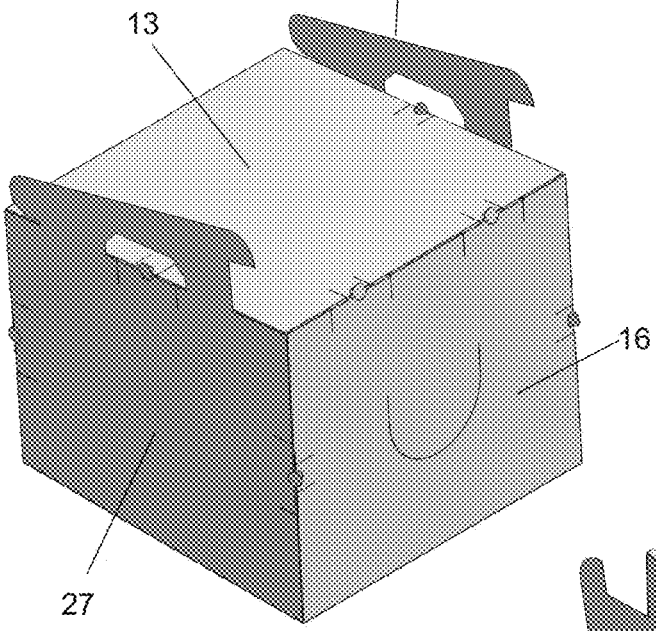
FIG. 13 shows already mounted display box.

After, the creases of the bottom (7), creases (14) of the side face (13) and creases (17) of the top (16) are folded, as shown in FIG. 8, aligning their cutouts (9) to the flaps (23) of the front faces (27). Then, as shown in FIG. 9, the locking tabs (25) are folded in order to be inserted in the angled terminals (10) while the locking tab (10*a*) is also folded and inserted in the cutout (22*a*) to lock the front faces (27), after its verticalization through the creases (2), as shown in FIG. 10, thus mounting the display box (35), completing the lock with the joining of the male locking tab (8*a*), as shown in FIGS. 11, 12 and 13. Thus the trapezoidal display box (35) is formed with wider top (16), suffering gradual reduction in the perimeter to the bottom (6).

Figure 14:
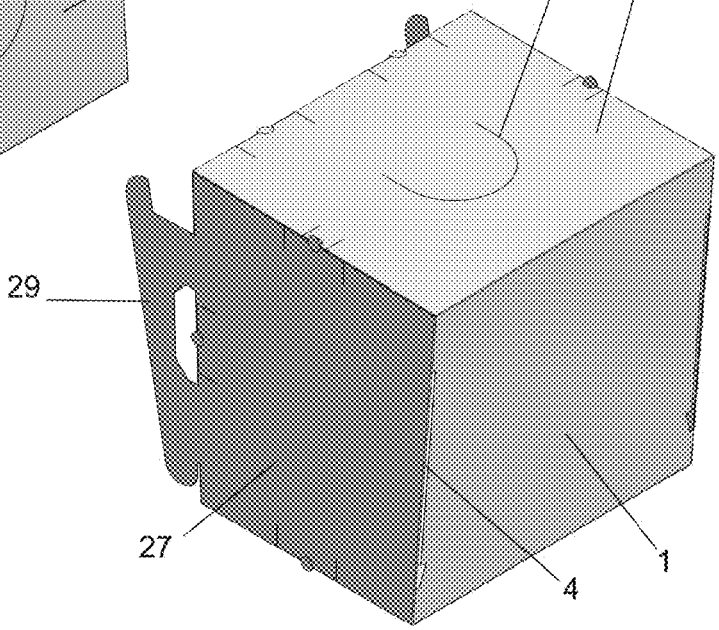
FIG. 14 shows the display box turned to the position of use.
Figure 15:
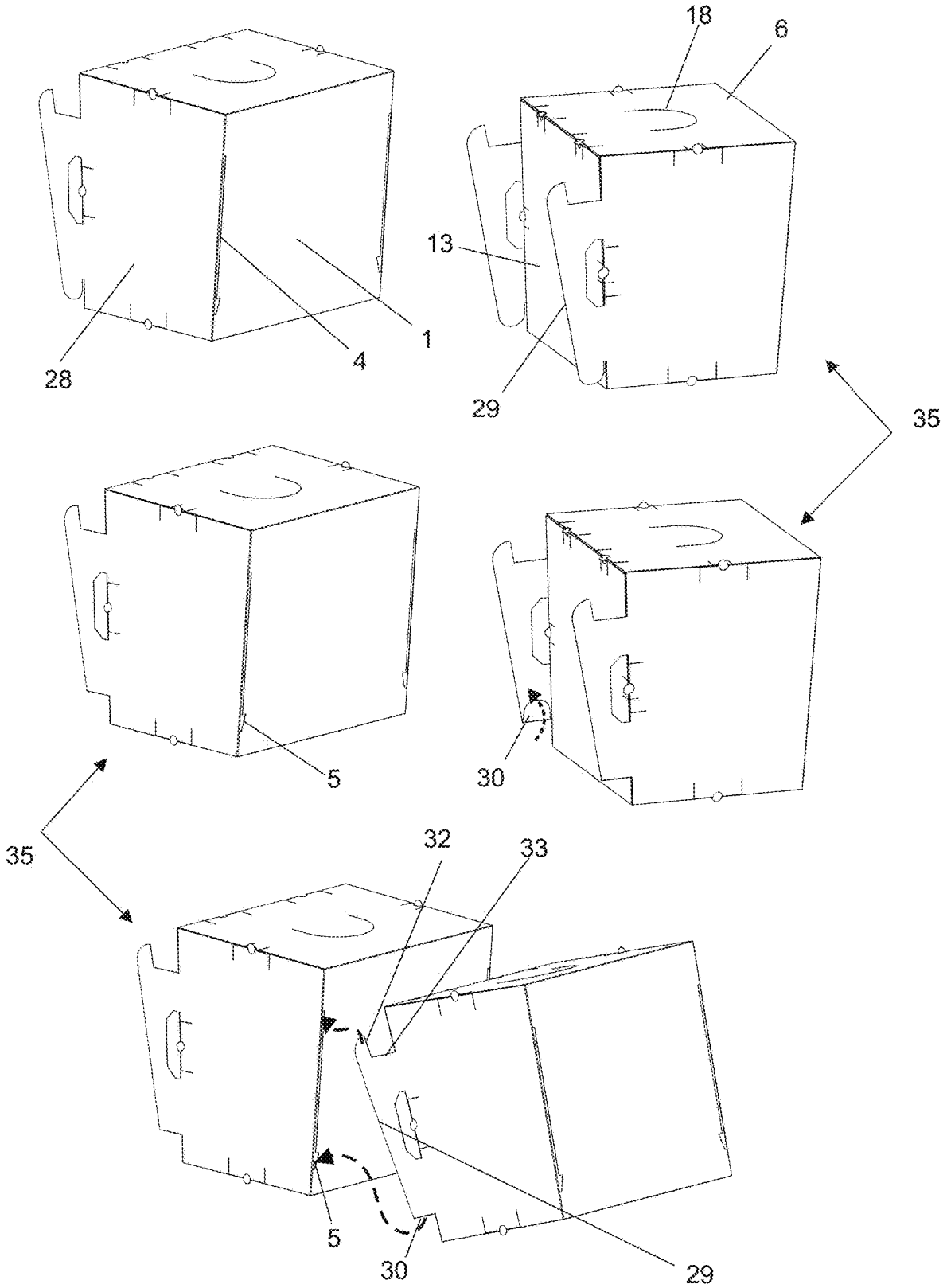
FIG. 15 shows, in sequence, a display box with its coupling flaps aligned to the corresponding cutouts of a subsequent box. With slight tilting of the box, the coupling flap is aligned to surpass the cutouts of the subsequent box.
Figure 16:
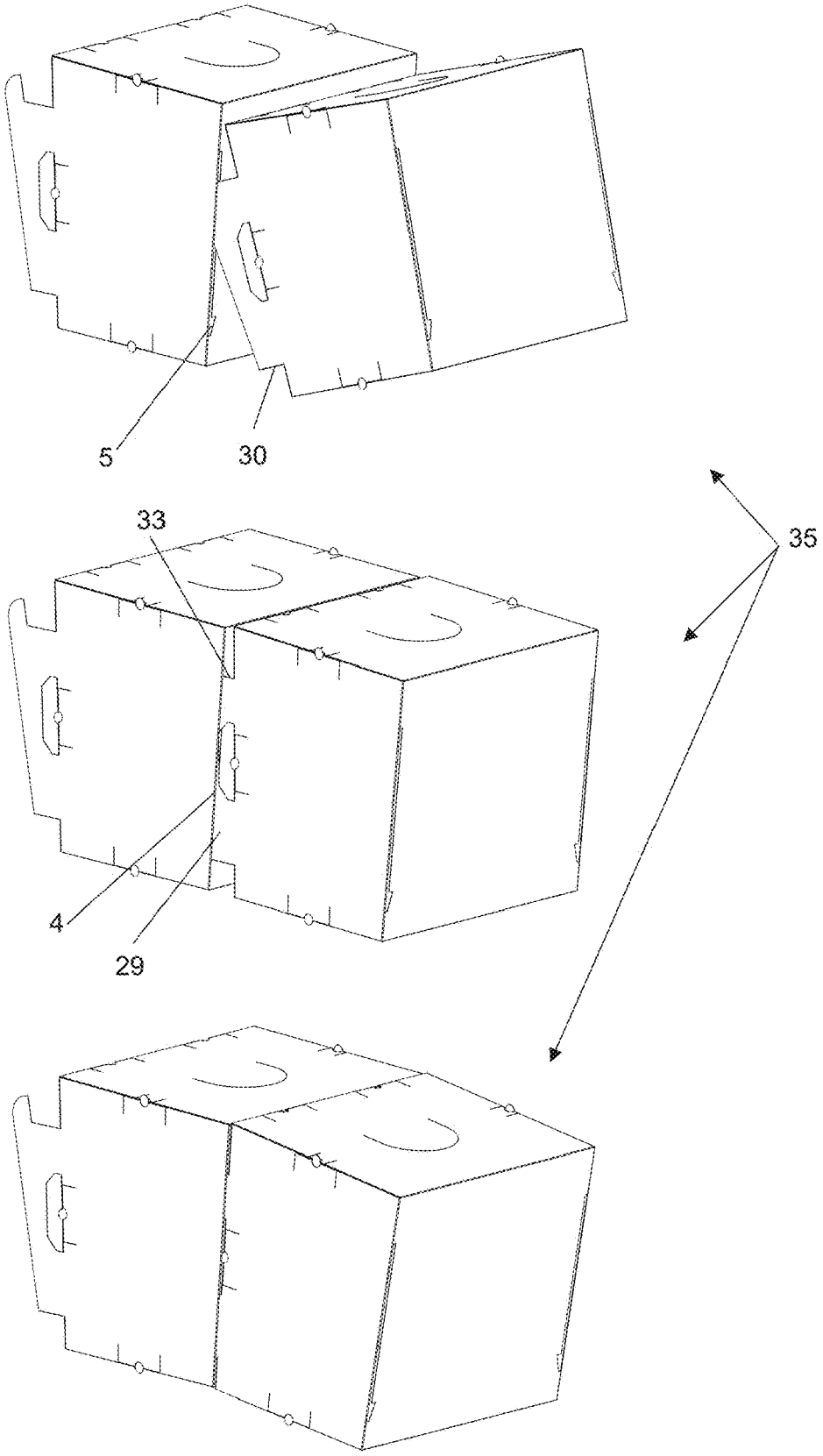
FIG. 16 shows, in sequence, after the slight tilting, the coupling of the initial box to the subsequent box.
Figure 17:
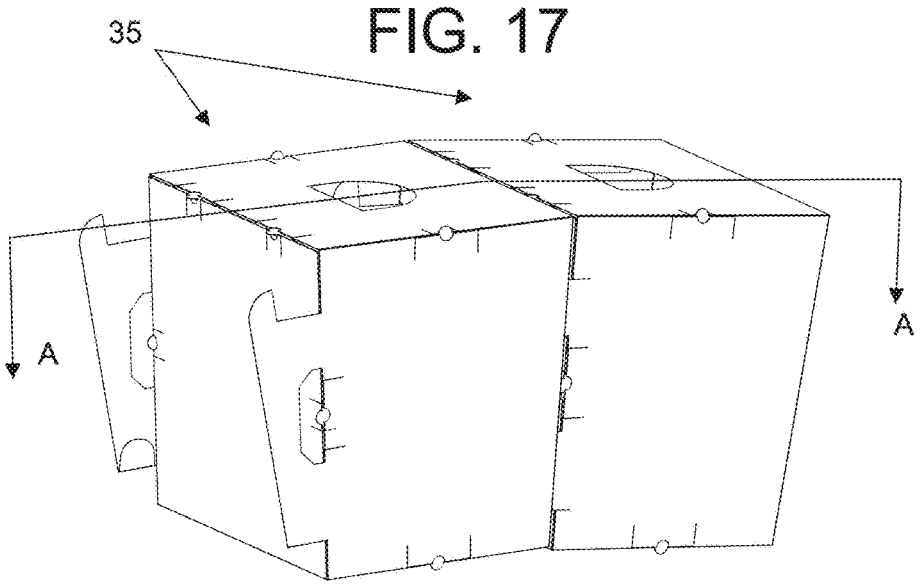
FIG. 17 shows two display boxes coupled to one another. This view indicates the A-A section.
Figure 18:
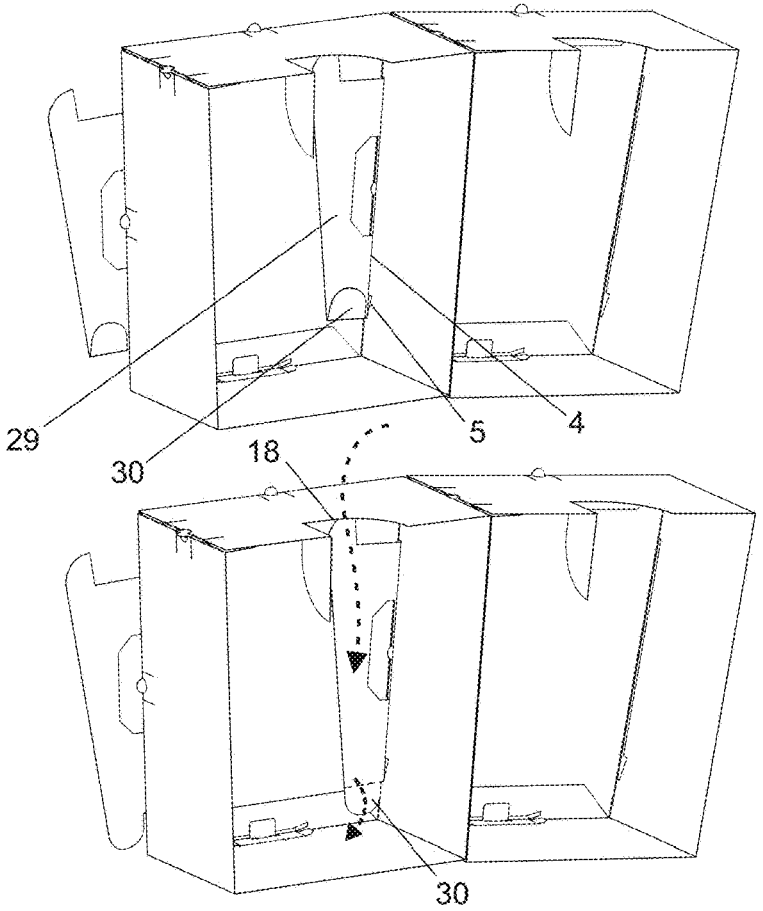
FIG. 18 shows views according to the A-A section, showing the internal lock of the locking flaps of the display box to the cutouts of the subsequent display box.
Figure 19:
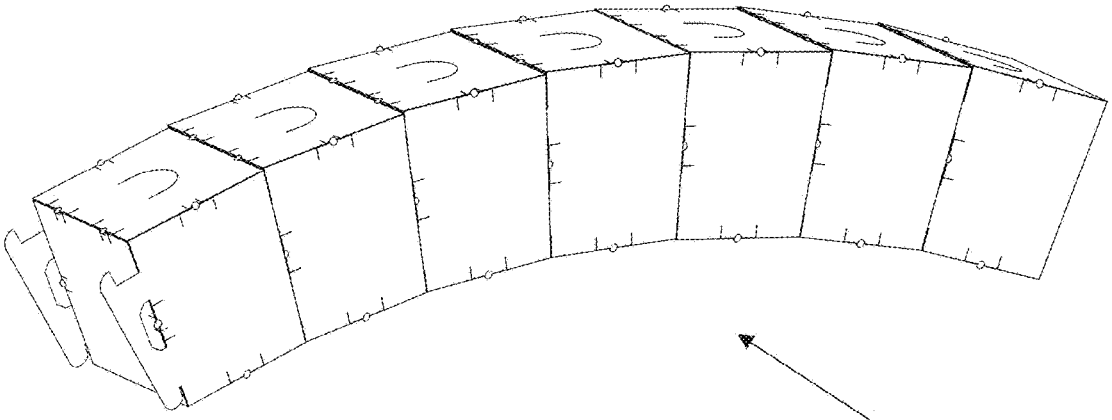
FIG. 19 shows a part of the arch of the assembly of coupled display boxes.
Figure 19:
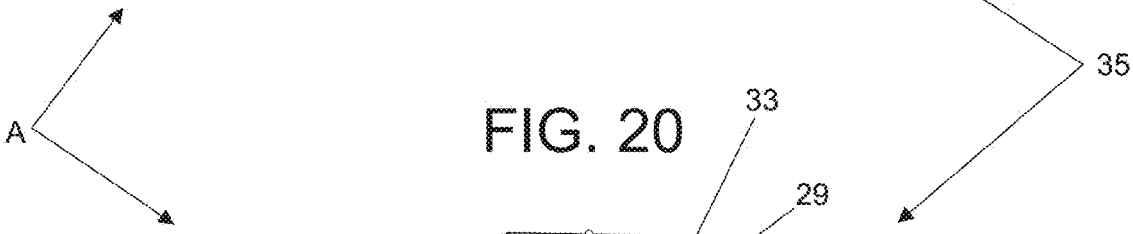

To use it, the top (16) is turned upward and the bottom (6) downward, as shown in FIG. 14, in order to be used in various units coupled together, in a new mounting system for an assembly through which a communication arch (A) is formed. For this purpose, as shown in the sequence of FIGS. 15 and 16, the coupling flaps (29) of a unit has the coupling ends (30) folded and, after this unit (35) is handled in slight angulation, the stop (32) is surpassed and inserted in the arrows (5) of the cutouts (4) of the subsequent unit (35). Then the assembler must insert his hand through the cutout (18), as shown by the arrow tracking the sequence of FIG. 18 of this subsequent box (35) and, internally unfold the coupling ends (30) that, when opened, lock one unit to another and so on successively, as shown in FIG. 19, forming an assembly of predefined extension for the installation site.

Figure 20:
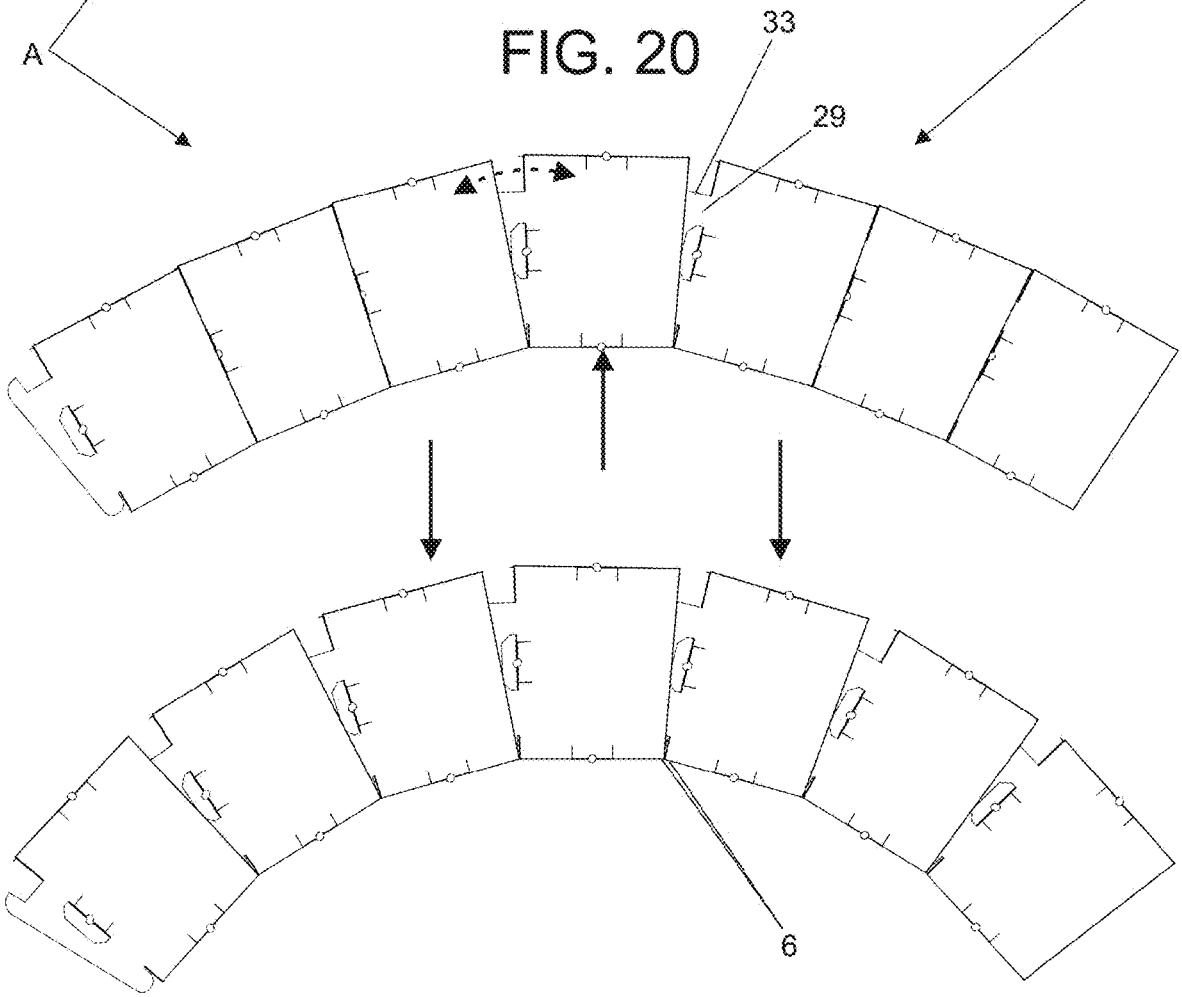
FIG. 20 shows, in sequence, the course of the locking flaps through the cutouts at the top of the display boxes, whose distance enables a radial pattern of the assembly. Simultaneously, the bottoms of these display boxes are forced against one another, structuring the assembly. This is how the communication arch is formed.
Figure 21:
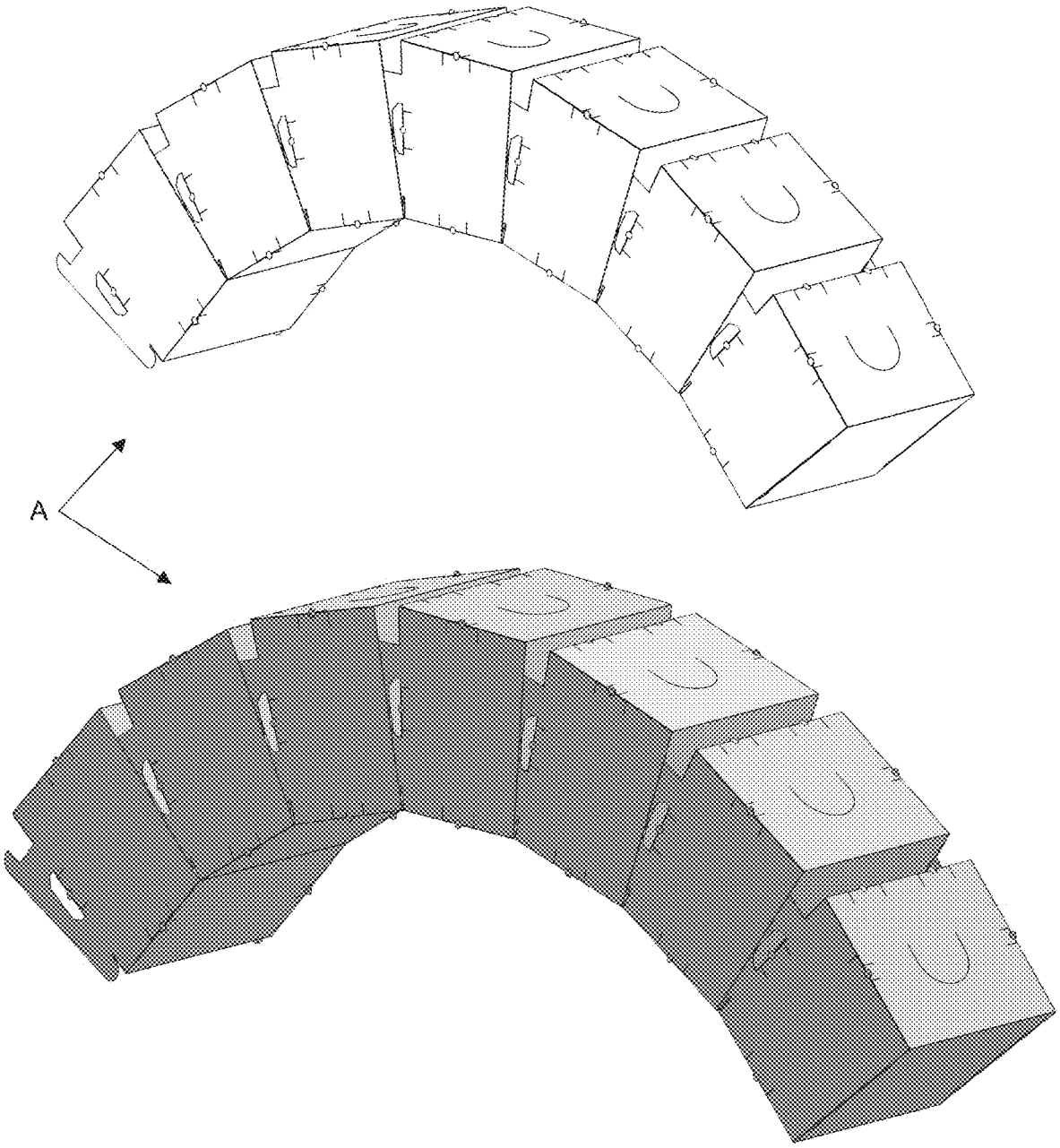
FIG. 21 is perspective views, with lines and rendered.

Through the proposed system, the assembly is raised through its central part, as shown by the arrow of the sequence of FIG. 20, when the displacement parts (33) of greater height of the coupling flaps (29) slide through its displacement parts (33) through the cutouts (4) of the subsequent displays (35) in a course delimited by the open coupling ends (30), simultaneously forcing the bottoms to meet (6). Thus, through the course of the coupling flaps (29), combined with the trapezoidal geometry of the display boxes (35), an adjustment movement is provided for spacing between the tops (16), in automatic radial position, while the bottoms (6) meet providing structuring, supporting the resulting stress imposed vertically from top to bottom, for the formation of the arch. FIG. 21 shows the communication arch in lines and rendered.

Figure 22:
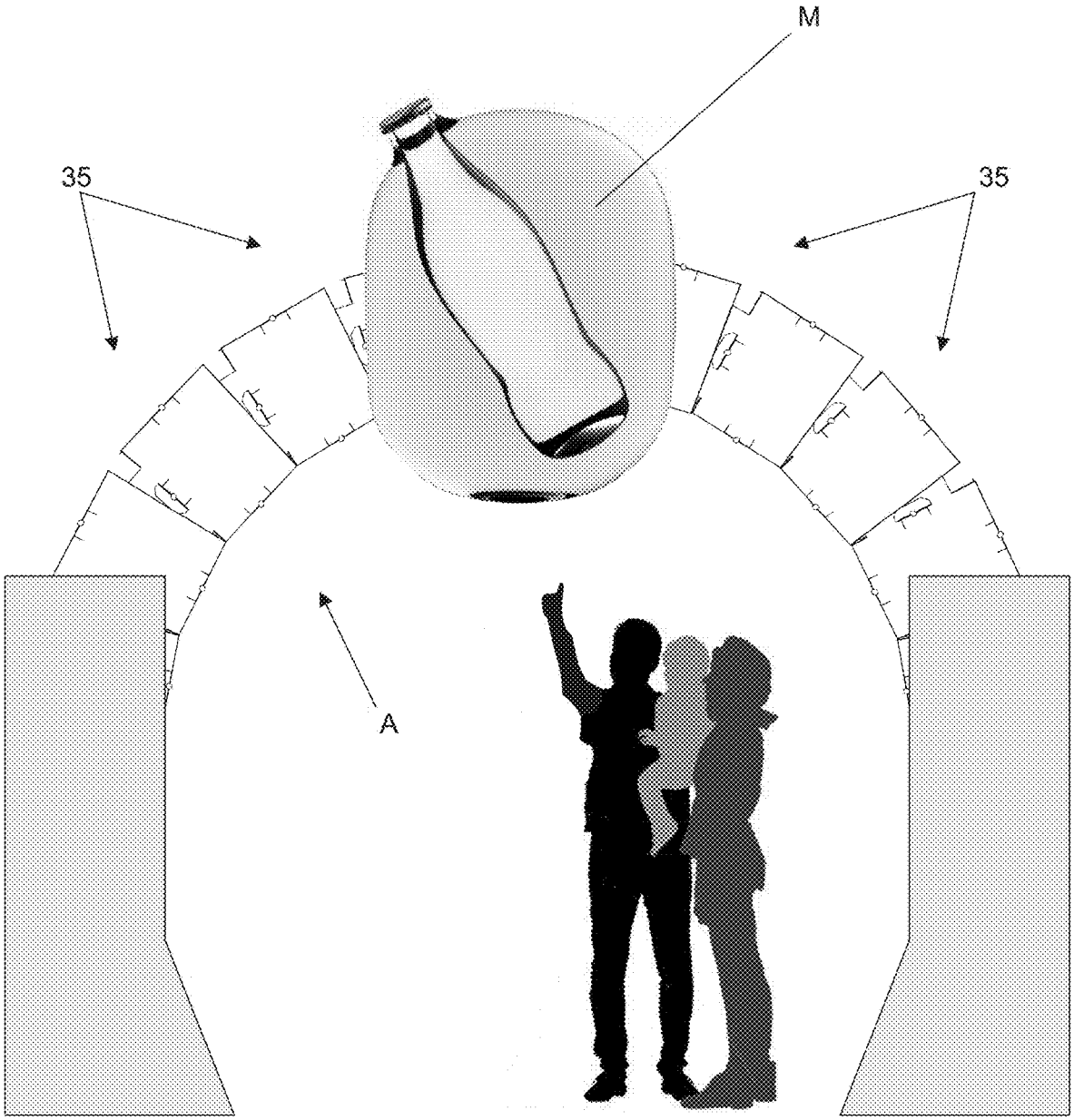
FIG. 22 is an illustrative view of the installed communication arch between two supermarket shelves for example.

Therefore, as shown in FIG. 22, the assembly can be supported by its peripheral display box (35) units, between two opposite shelves (G) in a supermarket corridor for example. Through its end of greater height, the communication arch (A) formed receives the fixation of a large media (M), which is maintained well above the corridor, calling the attention of consumers.

The invention claimed is:

1. A cardboard trapezoidal display box with cutting and creasing design, comprising a base (1) delimited by side creases (2) and (3) and that, on the creases (2) is characterized for receiving cutouts (4) with arrow end (5), extended to a bottom (6) from one of the creases (3), delimited by side creases (7) hollowed by male coupling (8) comprising a cutout (9) of angled extremities (10) and inclusion of a flap (11) with male locking tab (8*a*), and from crease (12) of the bottom (6) extends the side face (13) delimited by side creases (14), equally equipped with male coupling (8), as well as an opposite crease (15), receiver of a pair of male couplings (8), but in a cross-sectional position, while, from crease (3) opposite the base (1) extends a top (16), delimited by side creases (17) also equipped with their respective male couplings (8), said top (16) hollowed by a center cutout (18) delimiting semi-circle flap (19) and receiving, a free edge (20), a folding crease (21) of a female coupling (22) with its reentrant flap (23) by cutouts (24) and including a locking tab (25) with crease (26) interrupted by a rectangular center cutout opposite a semi-circular cutout, forming a female coupling (22*a*), also extending, from the creases (2) of the base (1), front faces (27) free edges equipped with crease (21) for its female couplings (22), being that, from its peripheral edge (28), the front faces (27) extend an angled coupling flap (29) defined by a coupling end (30) with supporting part (31), of smaller height and, on an opposite side, a stop (32) with displacement part (33), also receiving reinforcement in the inner face (34), thus forming the cardboard trapezoidal display box (35), with wider top (16) suffering gradual reduction in the perimeter to the bottom (6), in trapezoidal geometry.

2. The display box according to claim 1, characterized by a verticalization, from the creases (3), of the bottom (6) and top (16), folding, through the crease, (12), the side wall (13), and then folding its crease (15) to align the cutouts (10) of the male couplings (8) to the flaps (23) of the female couplings (22), whose locking tab (25) ends are folded for insertion in the angled extremities (10), then folding the locking tab (l0*a*) and inserting it in the cutout (22*a*) to lock the walls (6), (13) and (16), and then folding creases (7), (14) and (17), aligning their cutouts (9) to the flaps (23) of the front faces (27) after their verticalization through the creases (2), folding the locking tabs (25) for insertion in the angled extremities (10) while the locking tab (l0*a*) is also folded and inserted in the cutout (22*a*) to lock the front faces (27), thus mounting the display box (35).

3. A mounting system for the display box (35) of claim 1, characterized by the coupling flaps (29) of one unit (35) having the extremities of its coupling ends (30) folded for insertion in the arrows (5) of the cutouts (4) of the subsequent unit (35), said ends (30) opened manually by the insertion of the assembler's hand through the cutout (18) locking one unit to another and so on successively.

4. A formation of communication arch with automatic adjustment and structured system for the mounting system of claim 3, after raising a set from its central part and support of the display box (35) units between two points, such as between shelves for example, above a corridor, characterized by the displacement parts (33) of the coupling flaps (29) of a display box (35) slide through the cutouts (4) of the display box (35), from their tops (16), in a course delimited by the open coupling ends (30) for radial movement and positioning of the assembly, and so on successively, simultaneously forcing the bottoms (6) of these display boxes (35) to meet, in the shape of a communication arch (A) that receives a fixation of large media (M) displayed at great height.

5. A formation of communication arch with automatic adjustment and structured system for the display box claim 1, after raising a set from its central part and support of the peripheral display box (35) units between two points, such as between shelves for example, above a corridor, characterized by the displacement parts (33) of the coupling flaps (29) of a display box (35) slide through the cutouts (4) of the subsequent display box (35), from their tops (16), in a course delimited by the open coupling ends (30) for radial movement and positioning of the assembly, and so on successively, simultaneously forcing the bottoms (6) of these display boxes (35) to meet, in the shape of a communication arch (A) that receives a fixation of large media (M) displayed at great height.

* * * * *